United States Patent [19]

Strege et al.

[11] Patent Number: 4,822,385

[45] Date of Patent: Apr. 18, 1989

[54] EXHAUST CLEANSING APPARATUS

[75] Inventors: Gary L. Strege, Watertown; Gerd W. Renno, Cottage Grove, both of Minn.; Kirk A. Nelson, Hudson, Wis.; Stephen K. Melink, Madeira, Ohio

[73] Assignee: Maysteel Corporation, Mayville, Wis.

[21] Appl. No.: 72,902

[22] Filed: Jul. 14, 1987

[51] Int. Cl.[4] ..... B21D 47/02

[52] U.S. Cl. ..... 55/248; 55/249; 55/442; 55/DIG. 36; 55/257.3; 126/299 D; 126/299 E

[58] Field of Search ..... 55/225, 227, 248, 249, 55/257 QV, 436, 442, 445, 446, 478, DIG. 36; 126/299 D, 299 E

[56] References Cited

U.S. PATENT DOCUMENTS

| | | | |
|---|---|---|---|
| 2,392,038 | 1/1946 | Gaylord | 55/442 X |
| 2,564,074 | 8/1951 | Musante | 126/299 D |
| 2,564,075 | 8/1951 | Wray | 126/299 D |
| 2,813,477 | 11/1957 | Gaylord | 126/299 E |
| 3,021,777 | 2/1962 | Smith | 126/299 D |
| 3,390,400 | 6/1968 | Dock | 55/446 X |
| 3,778,979 | 12/1973 | Friedling et al. | 55/248 X |
| 3,785,124 | 1/1974 | Gaylord | 55/DIG. 36 X |
| 4,011,802 | 3/1977 | Molitor et al. | 55/DIG. 36 X |
| 4,047,519 | 9/1977 | Nett | 55/DIG. 36 X |
| 4,103,676 | 8/1978 | Kastner | 55/DIG. 36 X |
| 4,124,021 | 11/1978 | Molitor | 55/DIG. 36 X |
| 4,281,635 | 8/1981 | Gaylord | 55/DIG. 36 X |
| 4,376,434 | 3/1983 | Stahl | 55/DIG. 36 X |
| 4,493,312 | 1/1985 | Moon | 55/DIG. 36 X |
| 4,607,614 | 8/1986 | Higashino et al. | 126/299 E |

FOREIGN PATENT DOCUMENTS

| | | | |
|---|---|---|---|
| 24934 | 2/1986 | Japan | 126/299 D |

*Primary Examiner*—Charles Hart

*Attorney, Agent, or Firm*—Andrus, Sceales, Starke & Sawall

[57] ABSTRACT

An exhaust hood includes a collection chamber with a converging inlet passageway which directs the rising fume laden air downwardly toward a reverse turning area from which a baffled cleansing chamber extends upwardly. The collection chamber has a large top air capture pocket above the inlet passageway. The cleansing chamber includes alternating baffles on the opposite walls and generally a V-shaped in cross section with a smooth apex. The baffles define a generally serpentine for a mechanical cleansing path. The air cleansing nozzles permit periodic washing of the cleansing chamber surfaces. A common wall between the inlet passageway and cleansing chamber is pivotally mounted for access to the chamber. A water bath may form the bottom wall of the turning area. The stream angularly engages the bath with bath effective agitation, atomization and turbulence for mixing and removal of foreign matter from the air which then turns and moves through the cleansing chamber. The inlet passageway coverges downwardly to a narrow discharge slot having a short length with the end of the nozzle located close to the water surface to direct the air to the water bath. The level of the water bath changes the static pressure in the cleansing chamber. A pressure sensor is preferably used to add water to the bath to control the static pressure.

16 Claims, 2 Drawing Sheets

EXHAUST CLEANSING APPARATUS

BACKGROUND OF THE PRESENT INVENTION

The present invention is directed to a exhaust cleaning apparatus for cleansing fume laden air such as that rising form cooking equipment and/or other work equipment and particularly to an exhaust hood apparatus adapted to be combined with auxiliary enhancement devices including a water wash unit, a compensating air supply and the like for removing foreign matter from fume laden air and discharging environmentally clean air from the exhaust apparatus.

Exhaust hood apparatus is widely used for cleansing of the grease and particle laden air generated by a cooking surface and particularly such as that used in fast food restaurants for deep frying and cooking of product. Various exhaust hood units have been developed for cleansing of the air of particles and general foreign matter. The hood units may be formed with direct mechanical filter systems, with water wash systems and with a combination of mechanical filter systems and water wash systems.

A high satisfactory non-water wash and direct mechanical filter exhaust system is shown in U.S. Pat. No. 4,047,519 assigned to the present assignee of this application. In this and other systems, the fume laden air is passed directly upwardly into and through a mechanical filter arrangement for removing of the foreign matter as the result of the interengagement of the air with one or more mechanical filtering units. A significant and distinct improvement in the functioning of the systems results from the use of a compensating air stream generated by introducing an untempered outside or other air stream into the unit. The compensating airstream is introduced into the hood structure opposite the side of the hood housing the filter unit. THe stream is directed upwardly into the filter, and assists movement of the fume laden air upwardly from the cooking surface into and through the filter. Although various exhaust hoods have been suggested in this variety, the above patent discloses a particularly unique and highly satisfactorily system providing efficient cleansing of the air.

Under certain circumstances, it has been found that under certain conditions the exhausted air may still contaim some foreign matter, and does not provide optimum cleaning. One satisfactory system using a water wash for washing of the air with water to remove the foreign matter is shown in the co-pending application of Strege et al entitled "Exhaust Hood Apparatus For Cleansing Of Exhaust Fluid" which was filed on June 17, 1986 and is assigned to a common assignee with this application. As more fully disclosed in such application, the fume and foreign particle laden air rising from the cooking equipment or other work surface rises upwardly into the exhaust hood. tHe air is directed into a downwardly extending inlet passageway into a water wash unit located to one side of the exhaust hood. THe inlet passageway is a converging passageway for accelerating of the air flow into the water wash mechanism. The water wash unit includes a bath of water forming the bottom wall between the inlet passageway and a reverse upwardly directed water wash chamber. The water wash chamber is provided with a plurality of nozzles for generating a water wash spray with the fume laden air rising upwardly therethrough. A removable baffle unit is mounted within the upper end of the water wash unit exhaust passageway for rapid and effective cleansing of the air of all fume and foreign particles. In passing through the water spray, the grease and other foreign matter in the air is significantly removed and the water drops downwardly into the water bath for cleansing and recycling. The final baffle unit functions to remove the foreign matter which is not removed by the water wash as such. Various other water wash systems are disclosed in various other prior art patents submitted in the above application as well as in other prior art patents. Although the prior art widely uses spray nozzle, a spray environment or water falls for washing of the air had been suggested such that the high velocity stream engaging a water bath can aggitate the upper surface of the water to result in the mixing the the water and the air to provide a cleansing of the air. In such a system, the inlet passageway tot he water wash system includes a laterally directed baffle plate for varying of the opening of the inlet into the water wash and controlling of the size of the jet or the air directed into engagement with theater bath. The air is directed from the bath through a curved passageway for cleansing of the air. The above patents disclose similar water wash unit. U.S. Pat. No. 4,011,082 also discloses a compensating air stream specially constructed for assisting in movement of the fume laden air into t he water wash unit similar tot he compensating hood. The theory and functioning corresponds to that applied to the conventional nonwater discussed U.S. Pat. Nos. 3,978,777 and 4,047,519.

Although mechanical filter systems and the water wash system, particularly such as disclosed in the above patents and application of the present assignee, provided an effective and improved cleansing of the air, there is a continuing demand and need for a versatile design which can be incorporated into anyone of the several desired systems depending on the particular job specification and requirements, at a competitive cost efficient construction. The combination of the water wash and the special baffle unit may increase the cost significantly above that of a simple exhaust system. Although other water wash systems have been suggested, they do not provide the desired improved cleansing and may require even more complicated and expensive mechanisms for cleansing of the air and the like.

There is therefore a continuing demand and need for a basic exhaust hood adapted for direct use as well as improved water wash systems, with or without compensation air system, for cleansing of exhaust air from working areas and particularly cooking equipment. The exhaust hood must provide a relatively simple and cost effective air cleansing apparatus. The apparatus of course should also be particularly adapted for minimum maintenance including simple and reliable means for cleansing of the surfaces within the exhaust passageways.

SUMMARY OF THE PRESENT INVENTION the present invention s particularly directed to an improved exhaust fluid cleansing system for exhaust hoods and the like. Generally in accordance with the present invention, an inlet passageway directs the fume laden air downwardly toward reverse turning area form which a baffled exhaust cleansing passageway or chamber which extends upwardly. The collection chamber is formed within the structure with a large air capture pocket located above the inlet passageway for the effective and efficient collection of raising air, and particularly where a compensating stream is provided. The inlet passageway includes an inner converging section for smooth gradual acceleration of the air stream into the cleansing chamber. In a water wash unit, a water bath forms the bottom wall of the turning area and the high velocity stream engages the upper surface of the water bath at a relatively high velocity and selected angle of engagement whereas to provide a highly effective agitation, atomization and turbulence of the water surface resulting in a thorough mixing of water and air, with removal of foreign matter, including grease and the like. THe air turns and moves outwardly through the water cleansing chamber into an exhaust passageway which is preferably constructed with fixed baffle units protruding from opposite side into overlapping relation. THe cleansing chamber is specially constructed to develop a modified smooth tortuous path for the air to produce a centrifugal action on the foreign matter in the stream for further removal thereof. The tortuous path is particularly developed by baffle units having alternating inclined surface projecting inwardly from the opposite walls of the water wash chamber, and constructed to form alternating converging and expansion areas, such that the upwardly moving air is turned back and forth in moving upwardly and effects engagement with the underside of the baffled surfaces. THe combination of the effective agitation and atomization of the water surface and the special inclined baffle surfaces has been found to result in an effective cleansing of the air. Further, the structure provides a relatively simple and inexpensive construction while maintaining the desired effective cleansing characteristic to effectively and reliably remove foreign matter from the air. The maintenance of he system is effectively minimized by providing relatively simple flat cleansing surfaces which readily are cleaned and do not promote the accumulation of foreign matter.

In the water wash system, the level of the water bath effects the operation of the system, by changing the static pressure in the exhaust cleaning chamber. A pressure sensor is preferably used to add water to the bath to control t he static pressure within a desired operating range.

Further, an inner wall unit, formed as a common wall between the inlet passageway and the exhaust cleaning chamber, is pivotally mounted to establish access tot he cleansing chamber for periodic inspection a nd exhaust cleaning thereof.

In a preferred construction of the invention, the exhaust inlet passageway is specially constructed with a converging portion downwardly to a narrow discharge slot or nozzle having a short length with the end of the nozzle at or spaced outwardly from the water surface. The slot forms an air stream directed downward at a selected angular orientation to the upper surface of the water bath aligned with the inlet passageway and extended laterally therefrom beneath the water wash chamber. The cleansing wash chamber extends essentially vertically upwardly from the water bath, with an upper exhaust fan drawing of the air upwardly through t he cleansing chamber. THe exhaust fan also creates a draft fro drawing of the fume laden air into the inlet passageway.

The water wash chamber includes the alternating baffles. EAch baffle generally has a V-shaped cross section with a smooth curved apex located generally centrally of the exhaust chamber to define a generally serpentine or alternately curved path upwardly through the exhaust chamber. Spaced baffles are provided with chamber washing supply such as spaced nozzles coupled to a supply of wash down water for periodic washing of the surfaces in the exhaust chamber including the baffles.

An induction air stream unit may be provided to create an air stream passing across in the collection chamber to enhance the moving of air into and through t he exhaust cleaning chamber and to smoothly carry the fume-laden air into the inlet passageway. THe air stream unit is formed with the supply and slot constructions such as shown in U.S. Pat. No. 4,047,519. The inclined inner wall of the slot preferably extends upwardly as a smooth, flat wall to direct the stream upwardly into he large air capture pocket overlying eh inlet passageway of the exhaust cleaning passageway system. The upper wall of the capture pocket forms an extension of he slot wall to smoothly turn the air stream into the inlet passageway. Further, in the compensating hood, the supply slot an the inlet passageway slot have a similar depth to promote the efficiency operation of the system.

The present invention thus provides a further improvement in the construction of exhaust hoods particularly of the compensating type and which may include an efficient water wash system, and which further minimizes the complexity and costs of construction and subsequent maintenance with an efficient removal of the contaminants from air or other flowing gaseous medium and the like.

BRIEF DESCRIPTION OF THE DRAWINGS

The drawings furnished herewith illustrate the best mode presently contemplated by the inventor for carrying out the invention and which is described hereinafter.

In the drawings.

DESCRIPTION OF THE ILLUSTRATED EMBODIMENT

Figure 1:
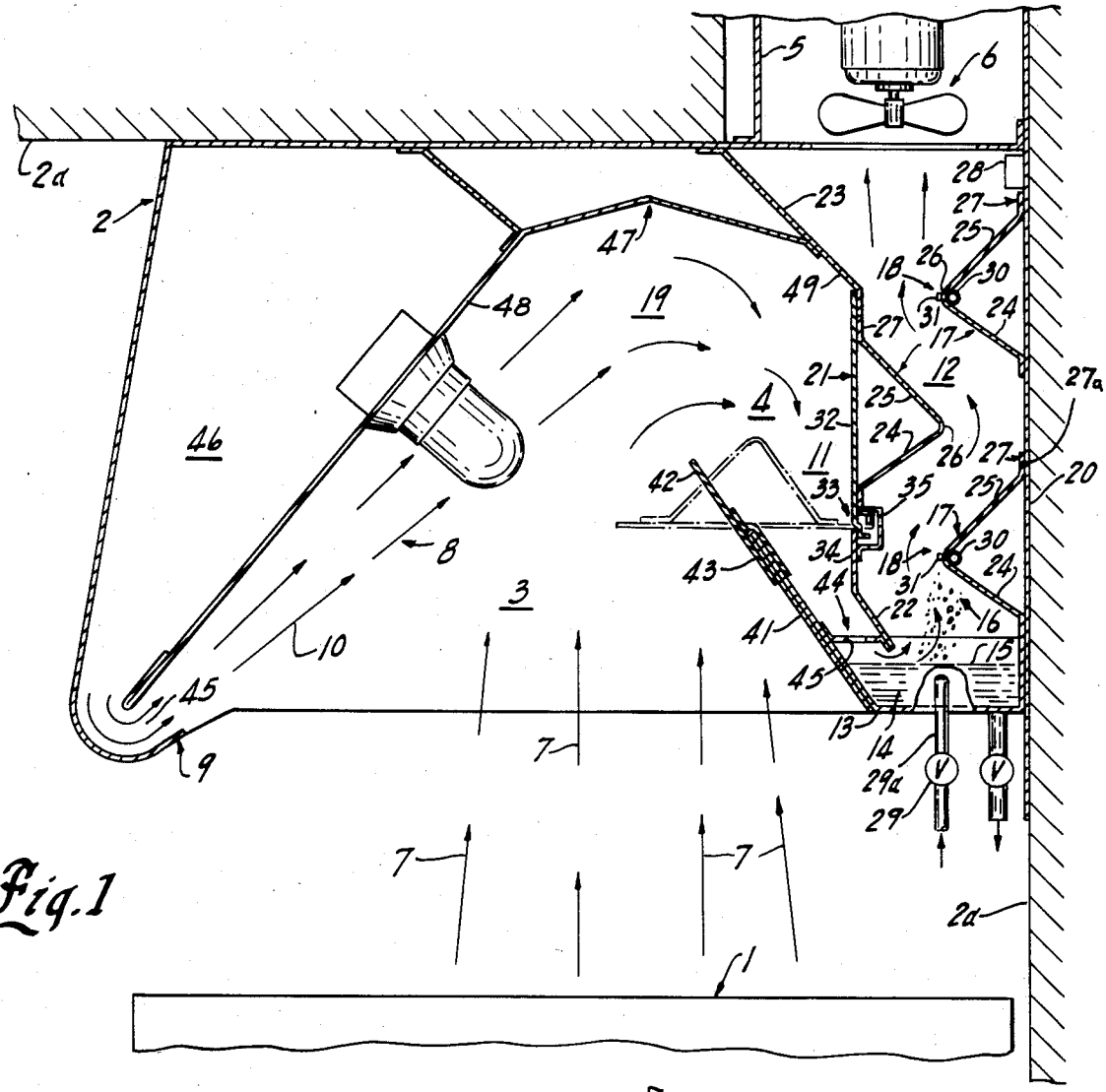
FIG. 1 is a vertical cross-section through the exhaust hood structure illustrating an embodiment of the present invention.
Figure 2:
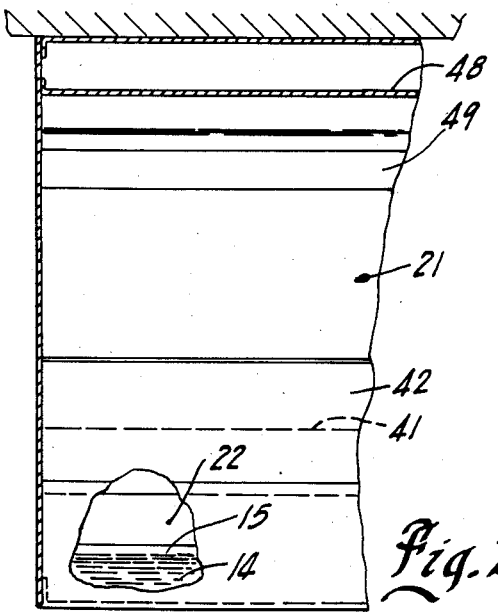
FIG. 2 is a partial front view with parts broken away and sectioned to illustrate inner detail of construction.

Referring to the drawings and particularly to FIGS. 1 and 2, a cooking range 1 is diagrammatically illustrated. THE range is typical of devices such as encountered in institutional kitchens, commercial fast food restaurants and the like. A wall-mounted exhaust hood 2 is mounted in upwardly spaced overlying relation to the cooking surface of range 1. the illustrated exhaust hood 2 is mounted to a wall and ceiling structure 2*a* with a vertical spring of the lower end allowing for free access to the upper surface of the cooking range 1. The bottom of the exhaust hood is open to provide entrance into an exhaust collection chamber 3 within the hood 2. An exhaust passageway and unit 4 is constructed within the back portion of the hood in communication with the collection chamber 3. An exhaust duct 5 projects upwardly as part of the exhaust passageway unit 4 and an exhaust fan 6 is mounted in the upper end ot he exhaust duct 5. The exhaust fan 6 creates a pressure to draw fume-laden air 7 from over the rang 1 into the exhaust hood 2. the illustrated exhaust hood 2 is an inductive compensating hood unit having an induction air stream source 8 located in the front or forward portion of the hood 2 and terminating in a nozzle 9 located on the inner lower edge of the front wall of the exhaust hood 2. The nozzle 9 generates an induction air stream 10 directed through t he collection chamber 3 and particularly extending from the lower front edge upwardly toward the exhaust passage unit 4. the use of the induction air stream is optional and is shown with a construction generally shown in the cited copending application. THe induction stream 10 functions to accelerate and enhance the drawing of the fume-laden air 7 into the collection chamber 3 for transfer into the exhaust passage unit 4. THE illustrated exhaust passage unit 4 includes a combined water wash and mechanical centrifugal filtering systems. The unit 4 includes a downwardly directed inlet passageway 11 connected to an adjacent upwardly directed cleansing passageway or chamber unit 12 to which exhaust duct 5 is connected. A water reservoir unit 13 is secured and forms the bottom portion of the inlet passageway 11 and the cleansing chamber unit 12. The inlet passageway 11 directs the fume-laden air 7, with the induction stream 10, downwardly toward the water reservoir unit 13, where the combined accelerating air flow 7 and 10 engages t he top surface of a water bath 14 and then reverses its flow and moves upwardly into chamber unit 12 discharging into exhaust duct 5 for discharge to the exterior. The accelerating air flow moves into engagement with the surface 15 of water bath 14 and creates a turbulent, whirlpool effect on the surface. The surface 15 in the absence of air flow overlaps the edge of nozzle all 22. This would serve to seal the exhaust passageway on fan shutdown. With air flow, the water moves to form a wave pattern against the back wall 20 and the underside of baffle 17, breaking over at about the apex of the baffle. The wave rolls over and breaks at its crest such as a normal wave and mixes with air more significantly. As a result, a substantial water surface areas is presented to the rapidly moving air which breaks down the water surface causes atomized moisture to mix in suspension with the air to scour the air at and within the chamber area immediately above the water surface and further to mix water with the air moving upwardly into the chamber 12. Chamber unit 12 is thus a combined washing and filtering system. The agitated cool water mixing with the air acts to condense grease and like products to effectively remove the foreign matter. A series of special baffle elements 17 are mounted on the opposite wall of the cleansing chamber unit 12 above the water bath 14. The movement through the baffled chamber of unit 12 serves to further scour the air and to impart a centrifugal action on the foreign matter in the air to remove the foreign matter which drops into the water bath 14. THe baffle elements 17 thus impart a cleansing movement on the air as the air moves upwardly through t he passage and promotes the scouring action and a mechanical removable of foreign matter as the air moves upwardly into he exhaust duct 5. THe cleaning water and the contaminants which are captured on the baffle elements also drop downwardly into the water bath or are held on the surface and are subsequently removed by washing of the baffle elements.

Washing nozzle manifold units 18 are shown mounted within selected baffle elements 17 for permitting periodic washing of the surfaces in chamber 12.

Briefly, in the illustrated embodiment of the invention, the fume-laden air 7 is drawn from over the cooking surface and is charged through duct 5, as follows. Exhaust fan 6, in combination with the special induction air stream 10 when provided, efficiently draws the fume-laden air 7 into and through the exhaust collection chamber 3. The air 7 moves upwardly within the chamber 3 and into an upper large capture pocket 19 at the entrance end of the inlet passageway 11, from where the air is accelerated and directed downwardly through a nozzle to the reservoir unit 13, where the air functions with agitating and turbulating engagement with the water bath, and makes a 180° turn over the water and into the cleansing chamber unit 12. THe air/water mixing and the action of the turburlent and agitated water 16, resulting form water bath engagement, scours the fume-laden air 7. The scouring action removes heavier particles from the air and the cooling effect of the water condenses the grease into water-carrying droplets. The greater portion of the foreign matter drops with the water droplets 16 into the reservoir unit 13 for discharge, either to a waste source, to a recycling system or the like. Any foreign material which is carried upwardly passes through the serpentine, tortuous passage 17 wherein additional foreign material is captured for subsequent removal by the construction of the baffle unit.

The upper end of the exhaust cleansing chamber 12 is coupled ot the exhaust fan 6 and serves to draw air from the collection chamber 3 through the cleansing system.

The vertically extended exhaust cleansing chamber 12 includes parallel, spaced vertical walls including an outer or back wall 20 and an inner wall 21. THe inner wall defines a common wall with the cleansing chamber 12 an the inlet passageway unit 11. tHE lower end of the inner vertical wall 21 is formed with an outwardly inclined extension wall 22 to form an elongated slot or nozzle which directs the accelerated stream onto the water bath 14. The upper end of the inner wall 21 includes an inwardly and upwardly extending wall 23 defining an expansion of the chamber 12 at its uppermost end.

The baffle elements 17 are shown including three vertically spaced baffle elements symmetrically secured to the opposite walls 20 and 21 of the chamber 12. In the illustrated embodiment of the invention, two of the baffle elements 17 are secured in vertically spaced relation to the back or outer wall 20 while the third baffle element 17 is mounted to the inner wall 21. Each baffle unit or element 17 is essentially identically constructed. Referring to the lowermost baffle element 17 shown secured o the back wall 20, the baffle element extends laterally across the extent of the hood coextensive with the inlet passageway 11. The cross section of the baffle element 17 has a generally V-shaped cross section including a flat-inclined bottom wall 24, and a flat, oppositely inclined top wall 25 joined by a smooth curved apex 26 to accommodate the wash down unit 18, as hereinafter described. Although this is a preferred construction, the apex 26 can be formed with a plurality of breaks to simulate a curved connection and in fact may be formed with a relatively sharp single connection if so desired. THe upper wall 25 is illustrated including a mounting flange 27 for securing of the baffle element to the back wall 20 as by a weld 27*a* or the like. tHe bottom wall 24 is shown of a somewhat shorter length than that of the top wall 25, as shown in FIG. 1. Thus, the angular orientation of the bottom wall 24 is slightly different than the angular orientation of the top wall 25.

The three baffle elements 17 are vertically spaced with the inner baffle element 17 of wall 21 located centrally between the outer baffle elements 17, and with essentially similar orientations of all elements to define a curved vertical passageway between the three elements. THe bottom shorter wall 24 and the longer top wall 25 of the opposed elements define a larger entrance opening to each portion within the vertical passageway such that there is a slight convergence from the lower end of each passageway portion to the upper and lateral portion of the same passageway as defined at each apex 26 of the upstream baffle elements 17. Simultaneously, therefore at the junction or apex 26 between t he passageway moves into an expansion chamber across the apex 26 of element 17 on wall 21 and then again converges to the apex 26 of the uppermost backwall baffle element 17.

In the illustrated embodiment of the invention, the short extension nozzle wall 22 on the inner wall 21 is angularly oriented and cooperates with the lower wall 24 of the lowermost element 17 to initiate the desired movement of the air and water mixture through the vertical cleansing chamber.

The baffle elements 17 are mounted with the apex essentially located centrally of the vertical exhaust chamber passageway and with the apex portions slightly overlapping to provide for a smooth, rapid turning action of the water and air through the exhaust passageway. The water and air move rapidly upwardly in the serpentine or circuitous curved path, and as a result of a centrifugal action resulting from the turning of air within chamber 12 as well as the engagement with the baffle elements 17, grease and other contaminants are removed.

The vertical cleansing chamber can be used with the induction air stream 10 in a compensating hood including the induction air slot structure as shown or alternately can be used in a simple hood structure without such compensating air wherein the exhaust fan serves to create the necessary flow of air into and through the cleansing chamber. Similarly, the cleansing chamber unit can be used without the water wash feature by removal of the water from the structure.

In the water wash system, the water level significantly affects the static pressure in the exhaust chamber passageway 12. The cleaning efficiency of the exhaust chamber has also been found to be significantly affected by the static pressure within the exhaust passageway. In the water wash system, a monitor is provided to maintain t eh proper water level. Because of the significant turbulence and agitation of the water surface 15 during he system operation, it is difficult to accurately determine the actual water level and thereby maintain a desired static pressure. Rather than therefore directly monitoring of the water level, a suitable pressure transducer 28 is preferably coupled to the chamber 12 to monitor the static pressure. THe static pressure is preferably sensed intermediate the vertical length of the passageway, as shown. The pressure transducer may, and preferably does, include high and lower limits and is coupled to a actuate a valve 29 in water supply source 29*a* to maintain a desired static pressure within the high and low limits of the monitor system.

Figure 4:
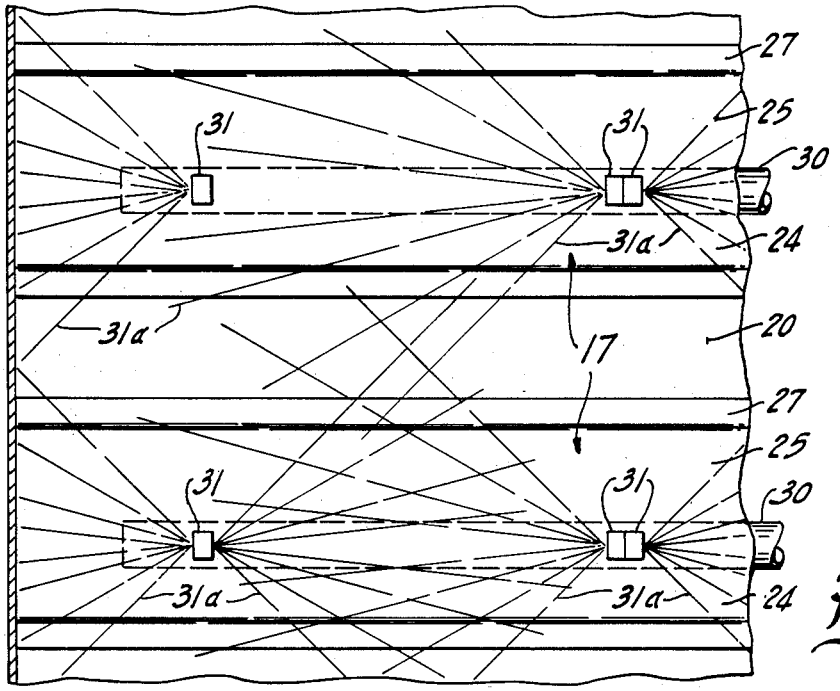
FIG. 4 is a diagrammatic view illustrating a cleaning spray pattern.

A significant problem associated with all kitchen type exhaust apparatus involves appropriate periodic cleaning of he apparatus. Generally the illustrated system includes a relatively large smooth surfaces particularly adapting all of the surface of the exhaust chamber to proper and rapid cleaning. A washdown system is provided including spray nozzle units 18 in each of the baffle elements 17 fixed to the back wall 20. A wash water manifold pipe 30 is mounted within the apex 26 of each of the baffle elements 17 on the outer wall 20. Suitable spray nozzles 31 are secured to he pipe along he extent of the element 17 and protrude from suitable openings within the apex of the baffle 17. The nozzle 31 as shown in FIG. 4 are oriented to establish an expanding spray cone of cleansing liquid directed parallel to the main extend of the baffle elements.

A pressurized source of water, not shown, which may include a cleaning agent such as detergent, establishes a pressurized cleaning liquid spray 31a. As shown in FIG. 4, each spray is directed outwardly and laterally throughout and toward all of the surfaces within the exhaust chamber 12.

The spraying nozzles 31 generate a spray pattern generally parallel to the baffle surfaces 24 and 25 in contrast to a perpendicular orientation such as used in other systems.

Although washing nozzles primarily create a parallel spray pattern, the expanding pattern directs a portion of spray ot engage surfaces perpendicularly rather than parallel to establish cleaning of all surfaces. Although te other systems can be used, the present spray pattern establishes further and overlapping coverage of all surfaces with a reduction in the number of necessary nozzles, which are generally relatively expensive components. The illustrated system also minimizes the amount of water used during a cleaning cycle. Actual tests have thus shown that the parallel spraying establishes a more efficient and effective practical cleaning of the surfaces as well as providing a highly cost efficient system with thorough cleaning of the surfaces. THe system is simple but produces effective and efficient cleaning of the exhaust chamber in a rapid and effective manner. The system may be manually or automically activated at periods when the exhaust air is not being cleansed.

Periodically, access to the cleansing chamber 12 and the baffle elements 17 is necessary for direct monitoring of the state of the baffles and to permit further cleaning if necessary or desirable and the like. The illustrated embodiment includes a special vertical inner wall 21 which forms the common wall with the inlet passageway 11. In particular, the upper portion or member 32 of wall 21 is pivotally mounted by a pivot unit 33 to a lower fixed wall portion or member 34 to permit pivoting of the upper member 32 of inner wall 21 to a horizontal position, resting on an upper edge of the inlet passageway wall 41 for access to the chamber 12 and baffle elements 17.

Figure 3:
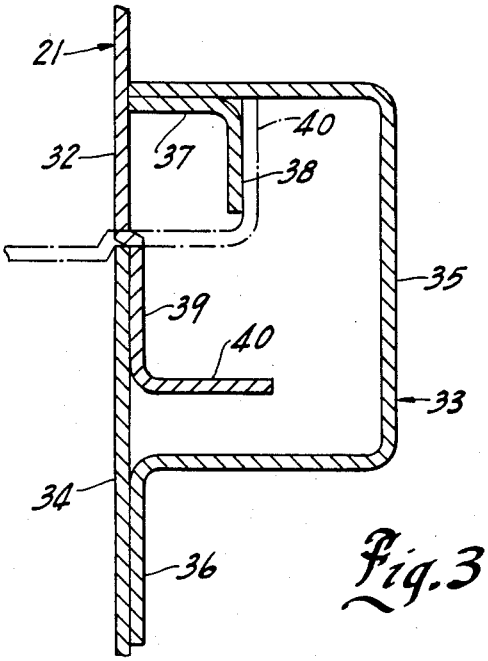
FIG. 3 is an enlarged fragmentary view of a pivotal wall support shown in FIGS. 1 and 2.

The pivot unit 33, as shown in FIGS. 1 and 3, is constructed to permit convenient pivoting and complete disassembly and removal of the upper member 32 of the inner wall 21. tHe fixed wall member 34 includes a supporting cross channel 35 extending across the hood and secured to the fixed wall member in any suitable manner as by a welded depending flange 36. the cross channel is an outwardly opening box-like member having a right angle stop element 37 secured to the top wall thereof. At the outer end of the stop is a depending lock plate 38 located centrally of the channel and depending downwardly from the center of the top wall.

The pivotal wall member 32 is secured by an offset pivot portion 39 which extends over the lower fixed wall member 34 into channel 35 to permit pivoting between the vertical and the horizontal orientations as shown. THe inner end of portion 39 projects laterally to form a stop plate or leg 40 extending horizontally inwardly into the channel 35. Pivoting of the wall member 32, as shown in phantom in FIG. 3, causes the leg 40 to move into engagement with the inner depending leg lock plate 38 of stop element 37 to limit the downward pivoting of the vertical wall member 32. The pivoting of wall 32 permits the convenient access to the chamber or inspection. Wall 32 can be completely removed by moving of plate 32 such that the stop leg 40 can be lifted through the entrance opening to channel 35 for cleaning maintenance and the like.

The inlet passageway unit 11 from the capture pocket 19 and collection chamber 3 to the cleansing chamber 12 includes an inclined wall 41 extending upwardly from the water bath unit 14 past the lower end of the vertical inner wall 21 and terminating in substantial downwardly spaced relation to the upper or top wall of the capture pocket 19. The wall is inclined at a significantly steep angle such as 50° to permit maximum exposure of the range or other surface to the collection chamber 3 and into the entrance portion of the capture pocket 19.

The increased angular orientation of the inner wall minimizes the interference with the upwardly rising thermal column and thereby promotes a smooth even flow of the fume laden air 7 into and with the induction air stream 10 into the capture pocket 19. The angle is preferably at least 50° to the horizontal and has been contructed at 55° from the horizontal. This is a significant increase from that shown for example, in the previously identified co-pending application, without the necessity of changing the other shapes and configurations of the cleansing chamber. The relatively steep angular orientation is thus desirable in promoting the efficient upward movement of the fume laden air 7 from over the cooking area into the collection chamber 3 and into the special capture pocket 19 formed above the opening to the inlet passageway. The steep wall structure is permitted because of the compact, narrow vertical exhaust chamber 12.

In the illustrated embodiment of the invention, the inclined wall 41 as such terminates at about the level of the wall hinge unit 33, is shown. However, a removable extension plate 42 is secured to the upper end of wall 41 an d forms a planar extension wall of such inclined wall. THe inventor has found that the extension wall increases the effective capture of air when the compensating stream 10 is used. The increased wall length increases the effectiveness in capturing the combined air streams. The extension plate 42 is shown as a simple flat plate member having a generally channel shaped coupling 43 adapted to telescope downwardly over the upper edge of the inclined wall 41. the extension wall 42 is supported by gravity on the inclined wall. THE extension wall 42 defines an elongated converging passageway for acceleration of the induction air 10 and the fume laden air 7 into the cleansing chamber 12.

The converging inlet passageway 11 terminates in t eh directional control slot 44 defined by the inclined wall 41 and the extension wall 22 on the lower end of the inner wall 21 for establishing a stream directed into proper angular engagement with the water bath 14 at the lower end of the cleansing chamber 12 and inlet passageway 11. The general depth and size of the inlet passageway slot 44 and the general depth and size of the induction air slot 45 of unit 9 are of essentially corresponding dimensions, and the inlet passageway slot is preferably just slightly less in depth than the induction air slot 45; although this is not critical. The similar slot relationship however does significantly contribute to the maximum and efficient flow of the induction air stream and of the fume laden air into and through the inlet passageway and into appropriate turbulent and agitating engagement with the upper surface of the water bath.

The removable extension plate is thus a convenient device to make the same basic hood structure with and without a compensating air supply unit 12. If the compensating air supply nozzle 9 is not built into the structure, the extension plate 41 is removed. In a non-compensated hood, the inventor has found a lowering of the inlet opening to the passageway 11 provides a greater and more efficient movement of the air 7 into passageway 11, as a result of an d responsive to the direct action of the exhaust fan 6, which of course serves as essentially the sole source for movement of the fume laden air 7 into the exhaust hood.

In either structure, the inlet opening in the hood structure is significantly spaced downwardly from the upper wall 47 of the collection chamber 3 thereby defining the large capture pocket 19 aligned with passageway 11 and within which the induction air 10 and/or the fume laden air 7 moves for appropriate turning into and movement through t eh inlet passageway 11.

In the illustrated compensating hood embodiment of the invention, the collection chamber 3 includes an inclined wall 48 of the compensating air supply nozzle 9. The wall 48 extends from and forms the inner wall of the induction air slot 45. The wall 48 extends angularly upwardly and rearwardly to the entrance of collection pocket 19. The uppermost wall 47 overlying the pocket 19 is shown constructed as a generally curved wall. The curvature is defined by a shallow inverted V-shaped wall 47 forming a connecting between the inclined inner wall 48 and an inclined wall portion 49 of the exhaust chamber inner common wall 21 and particularly the pivoted wall member 32. The use of a plurality of breaks in a metal member forming the upper wall 47 creates an essentially curved wall structure, and is used for the economic fabricating of the wall structure.

Generally, the inclined wall 48 terminates and is connected to the V-shaped wall 47 on a extension of the plane of the inlet passageway inclined wall 41 to define the opening to the collection pocket 19. This develops a relatively large mass of fast moving air from t eh induction air stream 10 and the fume laden air 7 rising upwardly from the work surface. Thus, the illustrated water wash system with compensating air systems has been found to provide a highly effective and efficient cleansing system. Although the various advantages, features and enhancement provided by the water wash and by the compensating air systems are necessary and cost justified in many applications, various installation do not require these features or cannot be used because of cost consideration. The enhancement features can be eliminated as required, with the basic exhaust hood providing a highly effective air cleansing in many environments.

Figure 5:
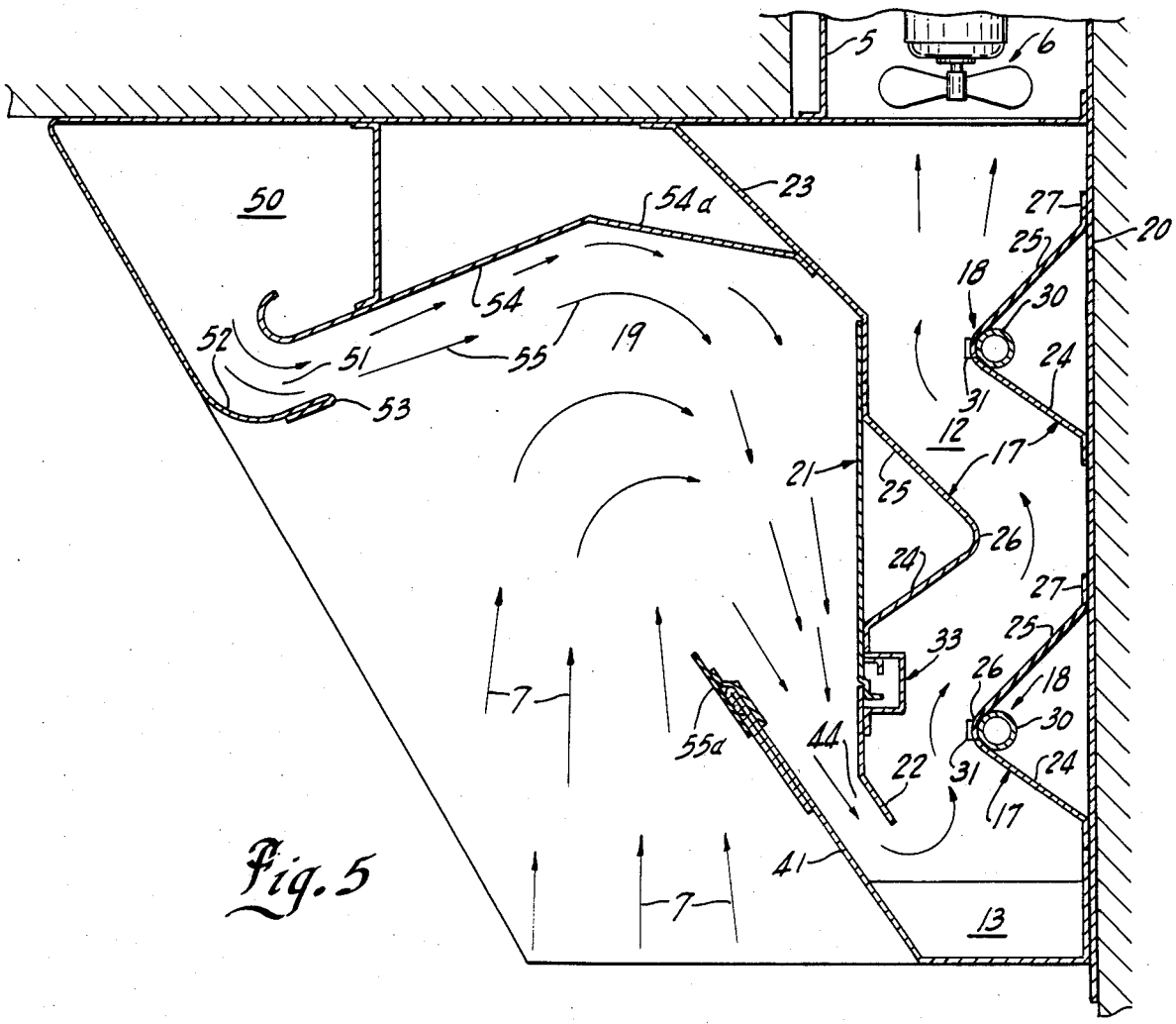
FIG. 5 is a vertical section of a backshelf exhaust hood unit constructed in accordance with the teaching of this invention.

The exhaust chamber structure can also be readily incorporated into a back shelf type hood such as shown in FIG. 5, wherein like elements of FIG. 1 are similarly numbered.

Referring to FIG. 5, the exhaust hood is shown as a direct mechanical filter exhaust hood with a compensating air supply unit 50 and without water in the water reservoir unit 13. The cleansing chamber unit 12 essentially corresponds to that shown in the canopy type hood of FIGS. 1–4. The top wall structure of the back shelf compensating hood has the supply unit 50 incorporated therein, generally similar to that disclosed in the issued U.S. Pat. No. 4,541,409. THe compensating air slot 51 is formed by a curved wall 52 terminating in a short bottom slot wall 53 which overlaps with a partial inclined top wall 54. The top wall 54 extends upwardly at a slight angle to a horizontal top wall member **54*a* of the capture pocket 19. The induction air stream 55 moves along the top wall 54 into the upper end of pocket 19 which provides smooth turning of the air into the chamber. In the backshelf hood, the compensating air slot may be larger thant eh discharge slot 44 because of the relationship of the air flows. Again, a substantial pocket 19 is formed above the inlet opening to inlet passageway 11** of the exhaust cleaning unit.

In the back-shelf hood, an inlet extension wall **55*a* is used. The wall 55*a*** is of a shorter extension because of a lesser opening of the compensating stream. For example, in a commercial application, a six inch extension was used in a canopy hood and a three inch extension in a backshelf hood.

Although the baffle elements 17 are shown with slightly different side lengths to create an accelerating passageway, the sides can be of the same length and acceleration created by having the distance between the apex and the opposite wall shorter than the distance between the parallel walls of the spaced baffles. Other constructions may also be provided. Similarly in practice, the water addition line is preferably located dropping down along the side wall of the hood and terminating just above the water level. This would prevent any backflow of the contaminated bath water back into the water system, which will generally be the usual portable water system at the installation. Further, the illustrated drain pipe is normally closed and periodically opened such as at the end of each day for cleaning of the water bath structure. If desired, a suitable recirculating system might also be used such as shown in the previously identified co-pending application.

In summary the present invention provides a significant improvement in the exhaust hood structure for application in mechanical filtering and for water wash exhaust cleansing systems, with and without compensating air in either system. The fixed baffle elements 17 are readily constructed with know technology and can be constructed and mounted as efficient with minimum expense while providing effective cleansing and ready and convenient cleaning of the surfaces. THE static pressure control for the water wash system promotes an effective cleaning action within the cleansing chamber while permitting very effective and simple control of the static pressure. The large capture pocket significantly increases the effectiveness of the exhaust hood without noticeably increasing the overall cost or maintenance of this system. the vertical orientation of the exhaust chamber permitted by the simplified baffle arrangement also permits the more effective construction of the hood to promote the rising of the thermal mass from the work area. The design of the access to the exhaust cleansing chamber permits a convenient access to all surfaces when necessary. The simplified automatic cleansing nozzle system also promotes a cost efficient hood while maintaining all of the necessary and in fact improving the cleansing of the surfaces.

Various modes of carrying out the invention are contemplated as being within the scope of the following claims particularly pointing out and distinctly claiming the subject matter which is regarded as the invention.

I claim:

1. An exhaust hood having a bottom opening for introducing fluid having foreign material to be removed, comprising a vertical collection chamber means having a top wall, and a front wall, a back wall and spaced sidewalls and having a a bottom end including a bottom opening and defining a collection chamber extending vertically upwardly from said bottom openings, a vertical exhaust cleansing chamber means mounted to the back wall of said collection chamber means and having a bottom inlet opening and an upper outlet opening defining a vertical cleansing passageway, an inlet passageway means connecting said collection chamber with said inlet opening, said inlet passageway means including a first inclined wall extending from the bottom end of the collection chamber means upwardly and inwardly into said collection chamber and a second wall spaced from said first inclined wall toward the exhaust cleansing chamber means and extending downwardly from the top wall of said collection chamber into downwardly overlapping relation to said first inclined wall to define an inlet passageway having a discharge end at the inlet opening to the exhaust cleansing chamber means, said inlet passageway having a vertically directed top open end, said collection chamber extending substantially upwardly above said top open end and upwardly above said first inclined wall and inwardly to s aid second wall, said second wall being substantially vertical and located substantially inwardly of said first inclined wall, and a curved wall connected to said second wall and extended over said top open end and defining an enlarged capture pocket having a horizontal opening substantially larger than said top open end and said pocket extending upwardly above the top open end of said inlet passageway, said inlet passageway forming a continuation of said capture pocket with a decreasing cross-section to said exhaust cleansing chamber means.

2. The exhaust hood of claim 1 wherein said exhaust cleansing chamber means includes spaced vertical and opposed walls defining the front and back walls of the cleansing chamber, a plurality of vertically oriented and spaced baffle units secured o the opposed walls of said exhaust cleansing chamber means, each of the baffle units having a substantially V-shaped cross-section and having a wide base secured to said wall of the exhaust cleansing chamber means and projecting inwardly into said cleansing passageway and into overlapping relationship with each other, said baffle units being vertically spaced with the baffle units on said opposed walls being offset to locate the baffle units on one walls paced from the baffle units on the opposed wall t o define a serpentine tortuous passageway, said baffle units having a substantially smooth apex of a substantially curved configuration and first and second straight side wall extending in opposite directions and at an angle ot a horizontal plane from said smooth apex, said side walls being of different lengths to establish a continuous air path moving upwardly with a continous alternate convergence and divergence in the tortuous passageway and with a substantially smooth flow characteristic, the shorter length side wall of each baffle unit being located in opposed relation to the longer side wall of the baffle unit on the opposed unit.

3. The exhaust hood of claim 1 including an air supply chamber means secured to said front wall and having an elongated induction air slot adjacent said bottom end and establishing an air stream directed upwardly into said capture pocket, said discharge end of the inlet passageway means having an elongated discharge slot of a substantially constant depth, said induction air slot having a depth substantially the same as said discharge slot.

4. the exhaust hood of any of claim 1 including a water reservoir unit containing a water bath and located in spaced relation to the inlet opening to said exhaust cleansing chamber means, said inlet passageway means directing said air to engage said water bath and agitate the water to introduce water into the exhaust cleansing chamber, and an exhaust fan unit mounted in the upper end of said exhaust passageway and producing a static pressure operable to draw water into the air flow in said exhaust cleansing chamber.

5. The hood of claim 1 wherein said first inclined wall includes an outer removable end section for varying the length of the inclined wall.

6. The hood of claim 1 wherein said collection chamber means includes a sidewall opening in the front wall of said collection chamber means, said side wall opening extending upwardly from the top end of said collection chamber means, and an induction air supply secured o the top wall of said hood and including an induction air slot adjacent said side wall opening establishing an air stream across the top of the collection chamber means to said capture pocket.

7. The exhaust hood to claim 1 wherein said second wall includes a pivotally mounted access wall section adjacent said top open end permitting access to said exhaust cleansing chamber means, and a pivot unit secured to said access wall section and to said second wall adjacent said access wall section, said pivot unit including an enclosure secured to the second wall and said access wall section has a member projecting into said enclosure and pivotal on the second wall.

8. An exhaust hood, comprising a vertical collection chamber means having a top wall and a back wall and spaced side walls and a bottom opening for capture of air moving upwardly form a surface, vertical cleansing chamber means in said back wall and having a bottom opening and a top opening, an exhaust fan coupled to said top opening, an inlet passageway means connecting said collection chamber means with said cleansing chamber means, said inlet passageway means including a first inclined wall extending from the bottom end of said back wall upwardly and inwardly into said collection chamber means and a second wall spaced from said first inclined wall toward the cleansing chamber means and extending downwardly from the upper end of said collection chamber means in overlapping relation to said first inclined wall, a plurality of vertically oriented and spaced baffle units secured within said cleansing chamber means, each of the baffle units defining a substantially cone-shaped member having a wide base secured to the wall of the chamber and side walls projecting inwardly at an angle to a horizontal plane and connected at the inner end by a smooth curved convex apex, the apex of the baffle units being substantially vertically aligned and said baffle units being alternately spaced to defined a serpentine tortuous passageway, said cone-shaped members being smooth and having essentially straight side walls to establish a continuous path of air moving upwardly with a continuous significantly smooth flow characteristic.

9. A compensating induction hood, comprising a collection chamber means having a top wall and a front wall and a back wall and spaced side walls and a bottom opening defining a collection chamber extending upwardly from the bottom opening for receiving fume-laden air, air supply means secured to said front wall and having an elongated supply nozzle of length and depth for introducing an inclined induction air stream extending upwardly over the top portion of collection chamber, a vertically inclined converging inlet passageway means secured to the back wall of the collection chamber means having an upper opening for receiving of the induction air stream and fume-laden air drawn upwardly and having a bottom discharge opening, said discharge opening including an elongated discharge nozzle, the supply nozzle and the discharge nozzle having an essentially similar depth and length.

10. The induction hood of claim 9 wherein said supply nozzle includes a depth which is constant and said discharge nozzle includes a depth slightly less than the depth of said supply nozzle.

11. The induction hood of claim 9 having a vertical cleansing chamber means extending upwardly from below said discharge nozzle and including a water reservoir unit forming a bottom wall at said cleansing chamber means, said reservoir unit having a portion aligned with said discharge nozzle and including a water bath having an upper surface closely spaced to said discharge nozzle whereby said air from said discharge nozzle creates a turbulent engagement with the bath and moves into said cleansing chamber means.

12. The induction hood of claim 11 wherein said collection chamber means includes an inclined planar upper wall extending upwardly from said supply nozzle with the air traveling along said wall, said collection chamber having substantially curved upper wall connected to the inclined planar upper wall to turn the air into said upper opening of said inlet passageway means.

13. The induction hood of claim 12 wherein said inlet passageway means includes an inclined wall defining said upper opening, said inclined wall having an uppermost end spaced from the curved upper wall of the collection chamber and generally in a plane passing through the connection between said inclined planar upper wall and said curved upper wall.

14. The exhaust hood of claim 13 wherein said inlet passageway means includes a vertical flat wall spaced from aid inclined wall and having an opening above said inclined wall and permitting access into said cleaning chamber from within said collection chamber, and a pivotal unit mounting said access member within said opening in said vertical wall.

15. The exhaust hood of claim 14 including a baffle element secured to said access member and projecting into said cleansing chamber, and said pivot unit is generally aligned with the uppermost end of said inclined wall.

16. The exhaust hood of claim 13 including an extension wall, means removably mounting said extension wall to said inclined wall and forming an extension of said inclined wall.

* * * * *

UNITED STATES PATENT AND TRADEMARK OFFICE

CERTIFICATE OF CORRECTION

PATENT NO. : 4,822,385

DATED : April 18, 1989

INVENTOR(S) : Gary L. Strege, Gerd W. Renno, Kirk A. Nelson

It is certified that error appears in the above-identified patent and that said Letters Patent is hereby corrected as shown below:

Col. 12, line 16, delete "a" (second occurrence); Col. 12, line 18, delete "openings" and substitute therefor -- opening --; Col. 12, line 52, delete "o" and substitute therefor -- to --; Col. 12, line 60, delete "walls paced" and substitute therefor -- wall spaced --; Col. 12, line 64, delete "wall" and substitute therefor -- walls --; Col. 12, line 65, delete "ot" and substitute therefor -- to --; Col. 13, line 5, delete "unit" (second occurrence) and substitute therefor -- wall --;Col. 13, line 11, before "having" delete -- means --; Col. 13, line 14, delete "the" and substitute therefor -- The --; Col. 13, line 47,

UNITED STATES PATENT AND TRADEMARK OFFICE

CERTIFICATE OF CORRECTION

PATENT NO. : 4,822,385

DATED : April 18, 1989

INVENTOR(S) : Gary L. Strege, Gerd W. Renno, Kirk A. Nelson

It is certified that error appears in the above-identified patent and that said Letters Patent is hereby corrected as shown below:

delete "form" and substitute therefor -- from --; Col. 14, line 2, delete "defined" and substitute therefor -- define --; Col. 14, line 23, after "nozzle," insert -- and --; Col. 14, line 42, after "having" insert -- a --; Col. 14, line 54, delete "aid" and substitute therefor -- said --; Col. 14, line 55, delete "cleaning" and substitute therefor -- cleansing --; Col. 12, line 61, delete "t o" and substitute therefor -- to --

Signed and Sealed this

Twenty-first Day of August, 1990

*Attest:*

HARRY F. MANBECK, JR.

*Attesting Officer*

*Commissioner of Patents and Trademarks*